US006438916B1

(12) United States Patent
Ueki

(10) Patent No.: US 6,438,916 B1
(45) Date of Patent: Aug. 27, 2002

(54) HOUSING PANEL, METHOD FOR MANUFACTURING HOUSING PANEL AND HOUSE USING PANEL

(75) Inventor: Tadashi Ueki, Kashiwazaki (JP)

(73) Assignee: Ueki House Kabushiki Kaisha, Niigata-Ken (JP)

( * ) Notice: Subject to any disclaimer, the term of this patent is extended or adjusted under 35 U.S.C. 154(b) by 0 days.

(21) Appl. No.: 09/614,550

(22) Filed: Jul. 12, 2000

(51) Int. Cl.[7] ..... E04B 1/74

(52) U.S. Cl. ..... 52/404.3; 52/404.1; 52/407.1; 52/764; 52/745.19

(58) Field of Search ..... 52/745.19, 309.8, 52/309.15, 404.1, 406.1, 407.1, 407.3, 404.3, 742.13, 762, 763, 764, 766

(56) References Cited

U.S. PATENT DOCUMENTS

| | | | | | |
|---|---|---|---|---|---|
| 3,693,304 | A | * | 9/1972 | Shell | 52/204 |
| 4,409,768 | A | * | 10/1983 | Boden | 52/309.4 |
| 4,509,571 | A | * | 4/1985 | Peters | 144/2.1 |
| 4,852,322 | A | * | 8/1989 | McDermid | 52/404 |
| 4,885,886 | A | * | 12/1989 | Rosso | 52/404 |
| 5,079,885 | A | * | 1/1992 | Dettbarn | 52/282 |
| 5,095,671 | A | * | 3/1992 | Mitani | 52/210 |
| 5,848,508 | A | * | 12/1998 | Albrecht | 52/309.9 |
| 5,966,894 | A | * | 10/1999 | Crump, Jr. | 52/729.4 |

FOREIGN PATENT DOCUMENTS

| | | |
|---|---|---|
| JP | 6-29292 | 8/1994 |
| JP | 2939579 | 6/1999 |
| JP | 11-190099 | 7/1999 |
| JP | 3018279 | 1/2000 |

* cited by examiner

*Primary Examiner*—Carl D. Friedman
*Assistant Examiner*—Jennifer I. Thissell
(74) *Attorney, Agent, or Firm*—Sughrue Mion, PLLC

(57) ABSTRACT

To provide a housing panel, a method for manufacturing the housing panel and a house using the housing panel that is high in quality with satisfactory heat insulating effect and low in manufacture cost, a housing panel for fitting with and closing a space surrounded by frame members such as columns, bases, lintels, tie beams, struts and rafters of a house. Outer members provided with grooves for fitting with a flat plate are arranged at least on both sides of the flat plate, and heat insulating material is provided in a space portion defined by the flat plate and the outer members.

20 Claims, 12 Drawing Sheets

HOUSING PANEL, METHOD FOR MANUFACTURING HOUSING PANEL AND HOUSE USING PANEL

BACKGROUND OF THE INVENTION

The present invention relates to a panel for building a house, a method for manufacturing the panel for building a house and a house using the panel for building a house.

In a conventional housing panel with heat insulating material, a frame body is formed, a flat plate is provided on one sided surface of the frame body, and the heat insulating material is provided on a surface opposite a surface where the frame body of the flat plate is provided. The housing panel is fit in a space surrounded by frame elements such as columns, bases, lintels, tie beams, struts, rafters or the like.

By the way, in this housing panel, the heat insulating material is provided on the surface opposite the surface where the flat plate frame member is provided, and it is necessary to prepare the heat insulating material having an outer size in conformity with a size of the outer form of the flat plate in advance. It is also necessary to bond the heat insulating material onto the flat plate accurately in alignment with the outer shape of the flat plate in order not to expand from the outer shape of the flat plate by using adhesives or the like. The conventional panel possesses a problem of increasing the manufacture cost due to the fact that the predetermined shaped heat insulating material is to be manufactured in advance and the heat insulating material is bonded on the flat plate in accurate alignment. Also, there is a problem in quality that the heat insulating material expands beyond the flat plate.

SUMMARY OF THE INVENTION

Accordingly, in order to overcome the above-noted defects inherent in the prior art, an object of the present invention is to provide a housing panel, a method for manufacturing the housing panel and a house using the housing panel that is high in quality with satisfactory heat insulating effect and low in manufacture cost.

According to a first aspect of the present invention, there is provided a housing panel for fitting with and closing a space surrounded by frame members such as columns, bases, lintels, tie beams, struts and rafters of a house, characterized in that outer members provided with grooves for fitting with a flat plate are arranged at least on both sides of the flat plate, and heat insulating material is provided in a space portion defined by the flat plate and the outer members.

In the housing panel according to the first aspect of the invention, according to a second aspect of the invention, the flat plate projects from at least one of end portions in a longitudinal direction of the outer members or projects from an outer surface of the outer members fitted with the flat plate.

In the housing panel according to the first aspect of the invention, according to a third aspect of the invention, a reinforcement member is laminated on an outer surface of the outer members.

In the housing panel according to the second aspect of the invention, according to a fourth aspect of the invention, reinforcement members are laminated on the outer surface of the outer members.

In the housing panel according to the third aspect of the invention, according to a fifth aspect of the invention, woody patterns of the outer members and the reinforcement members are arranged in a direction of lamination, and the woody patterns of the outer members and the reinforcement members are different from each other.

In the housing panel according to the fourth aspect of the invention, according to a sixth aspect of the invention, woody patterns of the outer members and the reinforcement members are arranged in a direction of lamination, and the woody patterns of the outer members and the reinforcement members are different from each other.

In accordance with a seventh aspect of the invention, there is provided a housing panel for fitting with and closing a space surrounded by frame members such as columns, bases, lintels, tie beams, struts and rafters of a house, characterized in that outer members provided with grooves for fitting with a flat plate are arranged at least on both sides of the flat plate, heat insulating material is provided in a space portion defined by the flat plate and the outer members, and the flat plate projects from at least one of end portions in a longitudinal direction of the outer members by a predetermined amount.

In the housing panel according to the seventh aspect of the invention, according to an eighth aspect of the invention, the flat plate projects from an outer surface of the outer members fitted with the flat plate.

In the housing panel according to the seventh aspect of the invention, according to a ninth aspect of the invention, a reinforcement member is laminated on an outer surface of the outer members.

In the housing panel according to the eighth aspect of the invention, according to a tenth aspect of the invention, reinforcement members are laminated on the outer surface of the outer members.

In the housing panel according to the ninth aspect of the invention, according to an eleventh aspect of the invention, woody patterns of the outer members and the reinforcement members are arranged in a direction of lamination, and the woody patterns of the outer members and the reinforcement members are different from each other.

In the housing panel according to the tenth aspect of the invention, according to a twelfth aspect of the invention, woody patterns of the outer members and the reinforcement members are arranged in a direction of lamination, and the woody patterns of the outer members and the reinforcement members are different from each other.

According to a thirteenth aspect of the invention, there is provided a housing panel for fitting with and closing a space surrounded by frame members such as columns, bases, lintels, tie beams, struts and rafters of a house, characterized in that at least one pair of confronting outer members having a shape in conformity with the space are provided in contact with the frame members, a flat plate is provided in a deeper position by a predetermined distance from both top and bottom end edges of the outer members within an inner surface of the outer members, a projecting piece is provided integrally with the flat plate on the outer surface of the outer members, and the projecting piece is formed so as to fit in grooves formed in the frame members to which the outer members contact.

In the housing panel according to the thirteenth aspect of the invention, according to a fourteenth aspect of the invention, a reinforcement member is laminated on an outer surface of the outer members.

In the housing panel according to the fourteenth aspect of the invention, according to a fifteenth aspect of the invention, woody patterns of the outer members and the reinforcement members are arranged in a direction of lamination, and the woody patterns of the outer members and the reinforcement members are different from each other.

Also, according to a sixteenth aspect of the invention, there is provided a method for manufacturing a housing panel for fitting with and closing a space surrounded by frame members such as columns, bases, lintels, tie beams, struts and rafters of a house, characterized by comprising the steps of providing outer members, provided with grooves for fitting with a flat plate, at least on both sides of the flat plate, and filling and pouring heat insulating material in a space formed by the flat plate and the outer members.

Also, according to a seventeenth aspect of the invention, there is provided method for manufacturing a housing panel for fitting with and closing a space surrounded by frame members such as columns, bases, lintels, tie beams, struts and rafters of a house, characterized by comprising the steps of providing outer members, provided with grooves for fitting with a flat plate, at least on both sides of the flat plate, filling and pouring heat insulating material by causing holder members to contact with upper and lower end portions of the flat member in a predetermined manner so as to prevent the heat insulating material, to be filled and poured, from overflowing from the flat plate to the outside, and after the heat insulating material has been cured, removing the holder members in contact with the upper and lower end portions of the flat plate.

According to an eighteenth aspect of the invention, there is provided a method for manufacturing a housing panel for fitting with and closing a space surrounded by frame members such as columns, bases, lintels, tie beams, struts and rafters of a house, characterized by comprising the steps of providing grooves for fitting with a flat plate in outer members, compressing a shape of fitting portions of the flat plate to be inserted into the grooves by pressurizing and depressing the fitting portions, and fitting the compressed fitting portions of the flat plate into the grooves of the outer members through adhesives.

In the method according to the eighteenth aspect of the invention, according to a nineteenth aspect of the invention, corrugations are given to the surfaces of the fitting portions.

In the method according to the eighteenth aspect of the invention, according to a twentieth aspect of the invention, a bottom side portion of the grooves of the outer members is widened.

In the method according to the nineteenth aspect of the invention, according to a twenty-first aspect of the invention, a bottom side portion of the grooves of the outer members is widened.

In the method according to the eighteenth aspect of the invention, according to a twenty-second aspect of the invention, a bottom side portion of the grooves of the outer members is rounded.

In the method according to the nineteenth aspect of the invention, according to a twenty-third aspect of the invention, a bottom side portion of the grooves of the outer members is rounded.

According to a twenty-fourth aspect of the invention, there is provided a house using a housing panel for fitting with and closing a space surrounded by frame members such as columns, bases, lintels, tie beams, struts and rafters of a house, wherein the housing panel characterized in that outer members provided with grooves for fitting with a flat plate are arranged at least on both sides of the flat plate, and heat insulating material is provided in a space portion defined by the flat plate and the outer members is used in at least one of a wall, a floor, a ceiling, a ridge and a roof.

According to a twenty-fifth aspect of the invention, there is provided a house using a housing panel for fitting with and closing a space surrounded by frame members such as columns, bases, lintels, tie beams, struts and rafters of a house, wherein the housing panel characterized in that outer members provided with grooves for fitting with a flat plate are arranged at least on both sides of the flat plate, heat insulating material is provided in a space portion defined by the flat plate and the outer members, and the flat plate projects from at least one of end portions in a longitudinal direction of the outer members by a predetermined amount is used in at least one of a wall, a floor, a ceiling, a ridge and a roof.

According to a twenty-sixth aspect of the invention, there is provided a house using a housing panel for fitting with and closing a space surrounded by frame members such as columns, bases, lintels, tie beams, struts and rafters of a house, wherein the housing panel characterized in that at least one pair of confronting outer members having a shape in conformity with the space are provided in contact with the frame members, a flat plate is provided in a deeper position by a predetermined distance from both top and bottom end edges of the outer members within an inner surface of the outer members, a projecting piece is provided integrally with the flat plate on the outer surface of the outer members, and the projecting piece is formed so as to fit in grooves formed in the frame members to which the outer members contact is used in at least one of a wall, a floor, a ceiling, a ridge and a roof.

According to a twenty-seventh aspect of the invention, there is provided a house using a housing panel for fitting with and closing a space surrounded by frame members such as columns, bases, lintels, tie beams, struts and rafters of a house, wherein the housing panel manufactured according to a method for manufacturing the housing panel characterized by comprising the steps of providing outer members, provided with grooves for fitting with a flat plate, at least on both sides of the flat plate, and filling and pouring heat insulating material in a space formed by the flat plate and the outer members is used in at least one of a wall, a floor, a ceiling, a ridge and a roof.

According to a twenty-eighth aspect of the invention, there is provided a house using a housing panel for fitting with and closing a space surrounded by frame members such as posts, bases, lintels, tie beams, struts and rafters of a house, wherein the housing panel manufactured according to a method for manufacturing the housing panel characterized by comprising the steps of providing outer members, provided with grooves for fitting with a flat plate, at least on both sides of the flat plate, filling and pouring heat insulating material by causing holder members to contact with upper and lower end portions of the flat member in a predetermined manner so as to prevent the heat insulating material, to be filled and poured, from overflowing from the flat plate to the outside, and after the heat insulating material has been cured, removing the holder members in contact with the upper and lower end portions of the flat plate is used in at least one of a wall, a floor, a ceiling, a ridge and a roof.

According to a twenty-ninth aspect of the invention, there is provided a house using a housing panel for fitting with and closing a space surrounded by frame members such as columns, bases, lintels, tie beams, struts and rafters of a house, wherein the housing panel manufactured according to a method for manufacturing the housing panel characterized by comprising the steps of providing grooves for fitting with a flat plate in outer members, compressing a shape of fitting portions of the flat plate to be inserted into the grooves by pressurizing and depressing the fitting portions, and fitting the compressed fitting portions of the flat plate into the grooves of the outer members through adhesives is used in at least one of a wall, a floor, a ceiling, a ridge and a roof.

Since the outer members provided with the grooves for fitting with the flat plate are arranged at least on both sides of the flat plate and the heat insulating material is provided in the space formed by the flat plate and the outer members, it is possible to readily provide the heat insulating material with high precision so as not to expand beyond the outer members. Moreover, since the heat insulating material is in contact with the top surface of the flat plate and brought into contact with the outer members provided at least on both sides of the flat plate, it is possible to enhance the bonding strength of the heat insulating material. It is therefore possible to bond the flat plate, the outer members and the heat insulating material with each other with high bondability to thereby exhibit satisfactory heat insulating effect. It is therefore possible to provide a housing panel that is high in quality and low in manufacture cost.

Since the outer members provided with grooves for fitting with a flat plate are arranged at least on both sides of the flat plate, and the flat plate projects from at least one of end portions in a longitudinal direction of the outer members by a predetermined amount, if the grooves are formed in the frame members so that the flat plate projecting by the predetermined amount may be fitted when the housing panel is to be fitted in the space surrounded by the frame members, in the case where the housing panel is fitted in the space, the housing panel is simply fitted in the grooves 6 of the frame members 1 so that the housing panel may very easily be inserted into the space portion. Moreover, the housing panel and the frame members take a structure in combination that is very high in mechanical strength. It is possible to provide a house that is superior in durability and anti-earthquake property.

Also, since the projecting piece is formed integrally with the flat plate from the outer surface of the outer members so that the projecting piece may be inserted into the groove formed in the frame member with which the outer members are to be brought into contact, when the housing panel is fitted in the space surrounded by the frame members for closing the space, if, for example, the grooves are formed in all the frame members on the space side, and the projecting piece is provided at the outer circumferential end portion of the housing panel in correspondence with these grooves, it is possible to fit and fix the projecting pieces at the outer circumferential end portions of the housing panel into all the grooves of the frame members forming the space, it is possible to mount and fix the frame members and the housing panel with each other very intimately and at the same time it is possible to provide a house that is much superior in structural strength to exhibit the heat insulating effect satisfactorily and that is superior in durability and anti-earthquake property.

Incidentally, even if the projecting pieces provided on the housing panel and the grooves provided in the frame members on the space side are not formed around the entire inner circumference of the space as described above, it is possible to select the parts, such as the upper and lower directions only, the right an left directions only, or the lower surface side only, as desired.

Also, since the flat plate projects on at least one side of the end portions in the longitudinal direction of the outer members or projects from the outer surface of the outer members fitted with the flat plate, when the housing panel is fitted in the space surrounded by the frame members, the grooves are provided on the space side of the frame members as desired so that a strength enough to attain the structural strength of the house in which the housing panels are fitted in the frame members and a fitting strength between the frame members and the housing panels may be set and the flat plate projecting to the outer circumferential end portions of the housing panel is provided as desired, whereby the housing panel may be fitted and fixed in the space surrounded by the frame members so as to attain the desired fitting strength or structural strength of the house.

Also, since the reinforcement members are laminated on the outer surface of the outer members, it is possible to provide a very high structural strength for the outer members. It is possible to suitably set the number of lamination of the reinforcement members to be laminated on the outer members in conformity with the specification of the structural strength of the housing panel. In the case where a size of the housing panel is large and it is impossible to form the portion corresponding to the length of the housing panel only with a single outer member, a plurality of segments of the outer members that are integrated with each other are used. When the reinforcement members are to be laminated on the plurality of integrated outer members, the components are laminated so that the position of the integrated portion of the outer members and the position of the integrated portion of the reinforcement members are different from each other to thereby provide a very high structural strength of the outer members.

Also, since the woody patterns (grains of wood) of the outer members and the reinforcement members are arranged in the direction of lamination, and the woody patterns of the outer members and the reinforcement members are arranged in different directions, it is possible to suppress the deformation such as warpage of the outer members and the reinforcement members to provide high precision and high quality of the outer members.

Also, since the heat insulating material is poured and filled in the space formed by the flat plate and the outer members, it is possible to positively pour and fill the heat insulating material over the space formed by the flat plate and the outer members without any gap. Moreover, since the heat insulating material is poured and filled so that the heat insulating material is bonded to the flat plate and the outer members with high bondability, it is unnecessary to use the adhesives for bonding the heat insulating material to the flat plate as in the conventional case. It is therefore possible to readily provide the heat insulating material to the housing panel and to provide a method of manufacturing the housing panel which is high in quality and low in manufacture cost with a satisfactory heat insulation effect.

Also, since the groove for fitting with the flat plate is provided in the outer members, the fitting portion of the flat plate to be fit in the groove is pressurized and depressed to compress the shape of the fitting portion, and the fitting portions thus compressed are fitted in the grooves of the outer members through adhesives, the compressed fitting portions of the flat plate inserted into the grooves of the outer members are adhered and expanded with the adhesives to be changed to return the original shape before the compression. Accordingly, the fitting portions of the flat plate are firmly and very intimately fitted and fixed within the grooves of the outer members though the adhesives. As a result, the flat plate and the outer members may be brought into very strong contact with each other in mechanical strength.

Also, since the housing panels are used for the walls, the floors, the ceilings, the ridges and the roofs, when the house is to be built, the housing panels are mounted and fixed in the spaces surrounded by the frame members, it is possible to build the house with ease to thereby make it possible to considerably shorten the building days for the house and to considerably reduce the building cost. In addition, the heat insulating effect of the housing panels is great so that the heat insulating effect of the house as a whole is also great.

DESCRIPTION OF THE PREFERRED EMBODIMENTS

Figure 8:
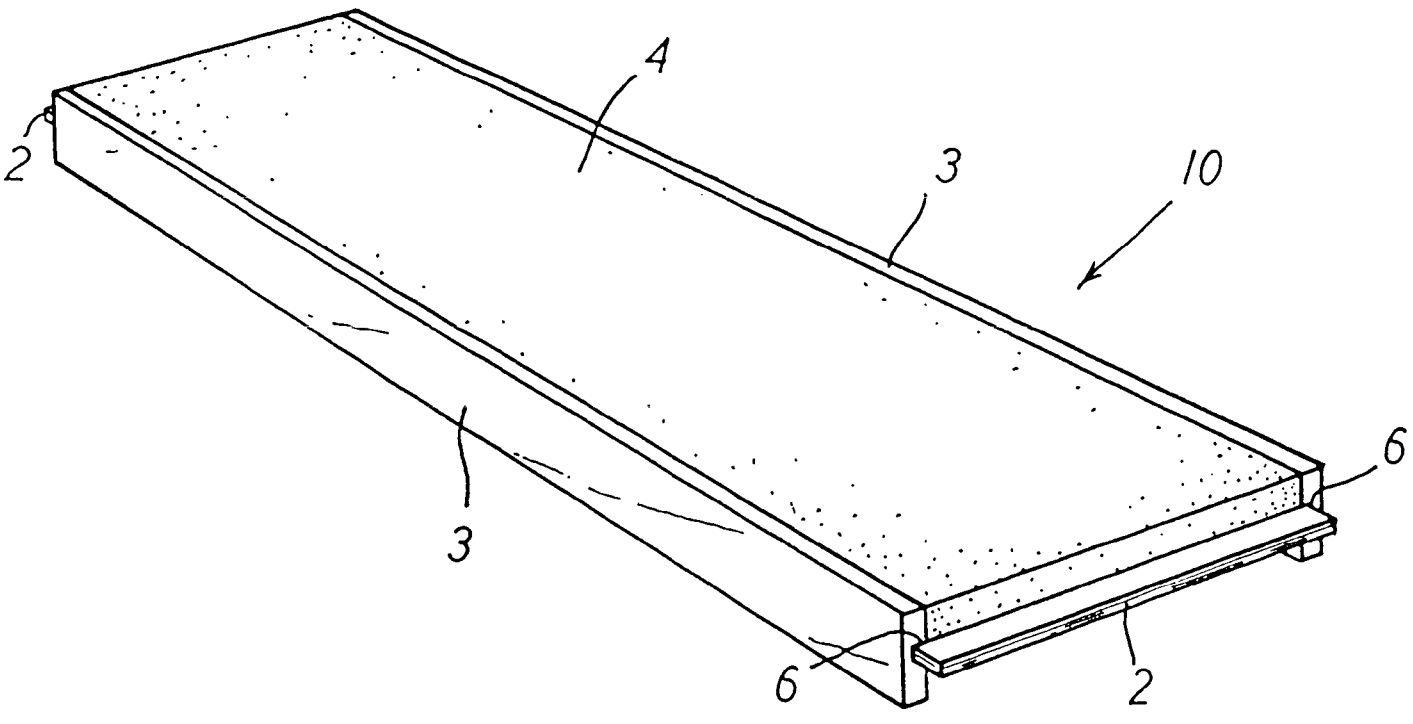
FIG. 8 is a schematic perspective view of a second embodiment.
Figure 9:
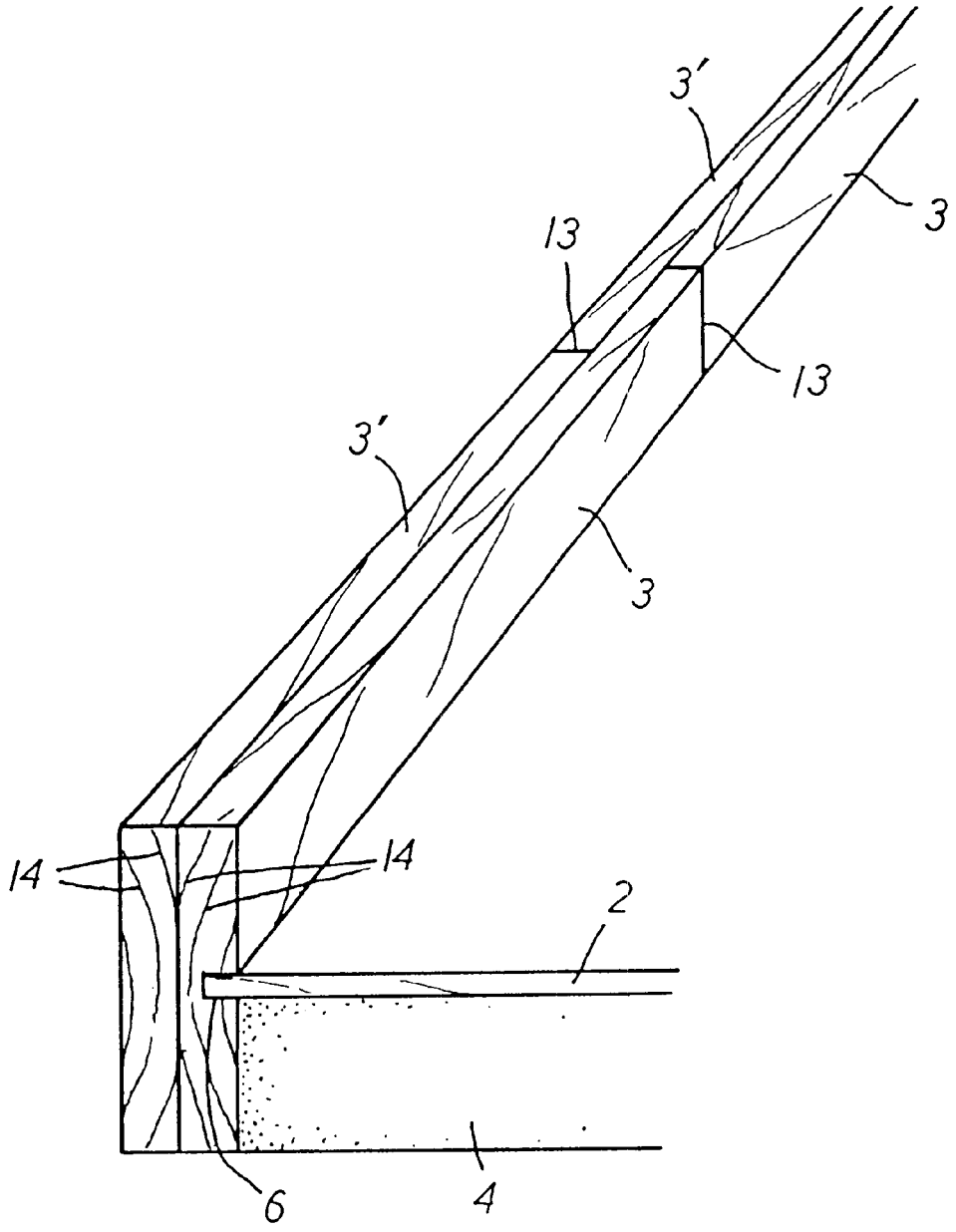
FIG. 9 is an enlarged perspective view of a primary part of the housing panel according to a third embodiment of the invention.
Figure 10:
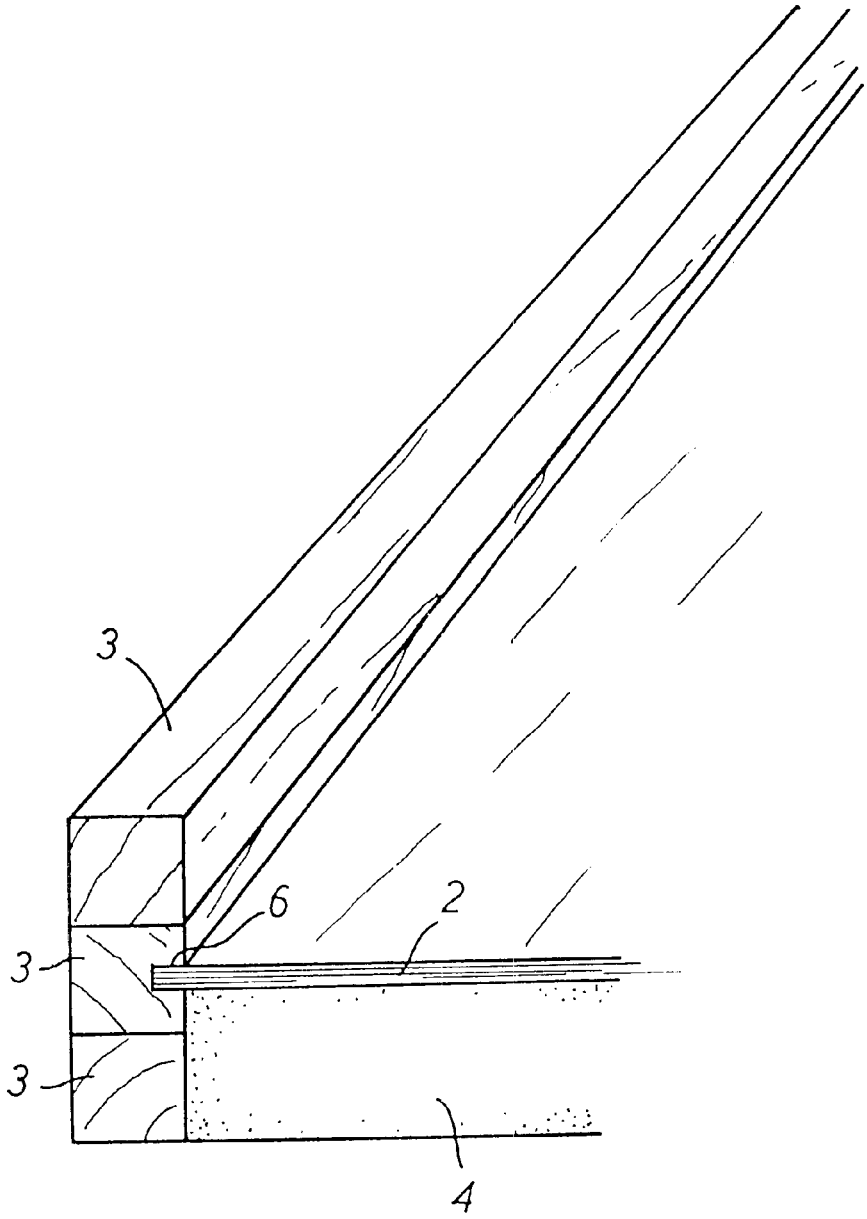
FIG. 10 is an enlarged perspective view of a primary part of the housing panel according to a fourth embodiment of the invention.
Figure 11:
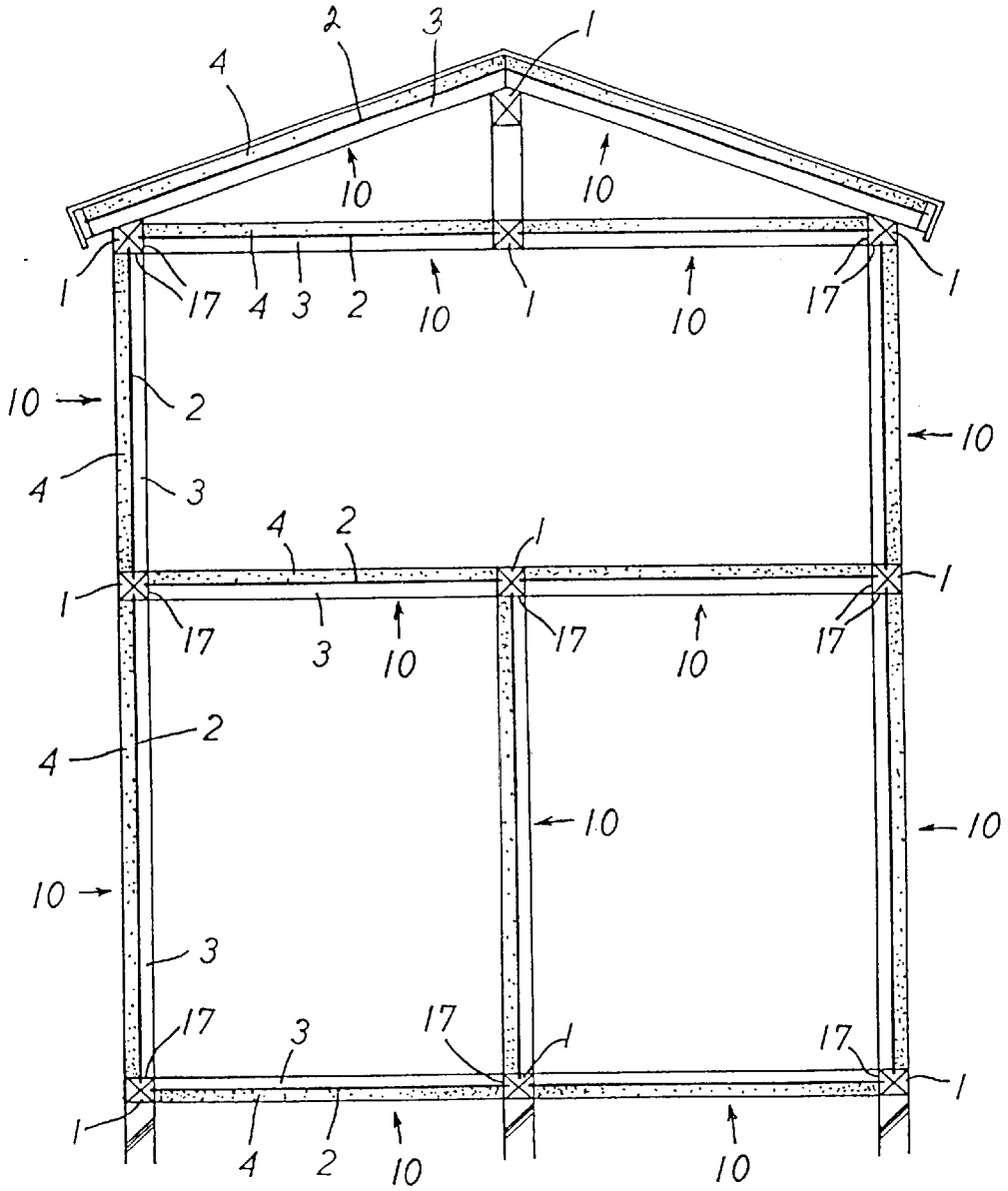
FIG. 11 is an illustration of a fifth embodiment.

Embodiments of the present invention will now be described with reference to the accompanying drawings. FIGS. 1 to 7 show a first embodiment, FIG. 8 shows a second embodiment, FIG. 9 shows a third embodiment, FIG. 10 shows a fourth embodiment and FIGS. 11 to 14 show a fifth embodiment.

In the first embodiment, a housing panel 10 is fit in a space 17 defined by frame members 1 such as columns, bases, lintels, tie beams, struts, rafters or the like for closing the space. A pair of outer members 3 are provided at least on both sides of a flat plate 2, and are provided with grooves 6 for fitting the flat plate 2. A heat insulating material 4 is provided in a space formed by the flat plate 2 and the outer members 3.

Figure 1:
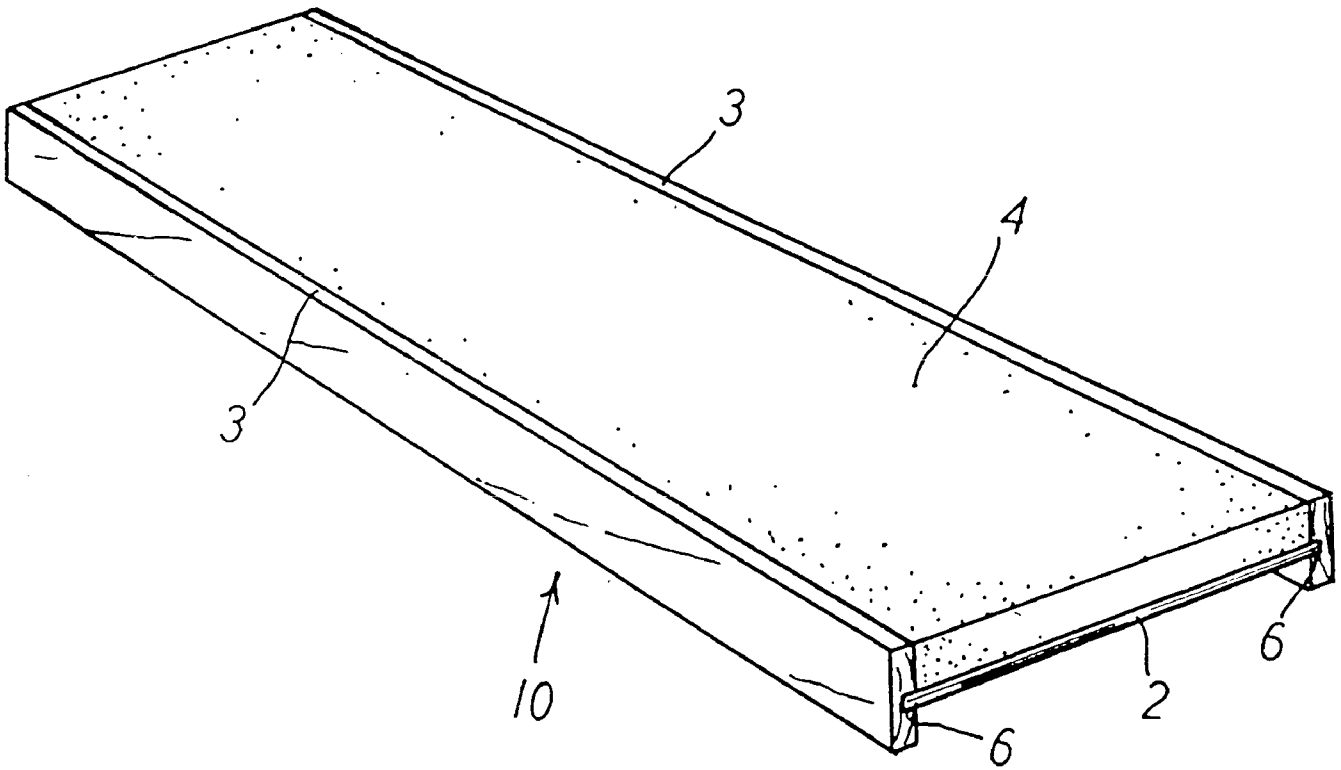
FIG. 1 is an illustration of a first embodiment.

FIG. 1 shows the outer members 3 provided with the grooves 6 for fitting with the flat plate 2 on both sides of the flat plate 2 but the outer members may be provided around the entire outer circumference of the flat plate 2.

Also, FIG. 1 shows the heat insulating material 4 that is provided only on one sided surface of the flat plate 2 in the space formed by the flat plate 2 and the outer members 3 but it is possible to provide the heat insulating material 4 on both surfaces of the flat plate 2 as desired.

Also, the heat insulating material 4 is provided by a method of filling and injecting the heat insulating material 4 into the space formed by the flat plate 2 and the outer members 3.

More specifically, the following method is adopted. The heat insulating material 4 is filled and poured into the space formed by the flat plate 2 and the outer members 3. Thereafter, in accordance with a kind of the heat insulating material 4 to be used, the heat insulating material 4 is cured naturally or the heat insulating material 4 is cured by the application of heat.

Figure 2:
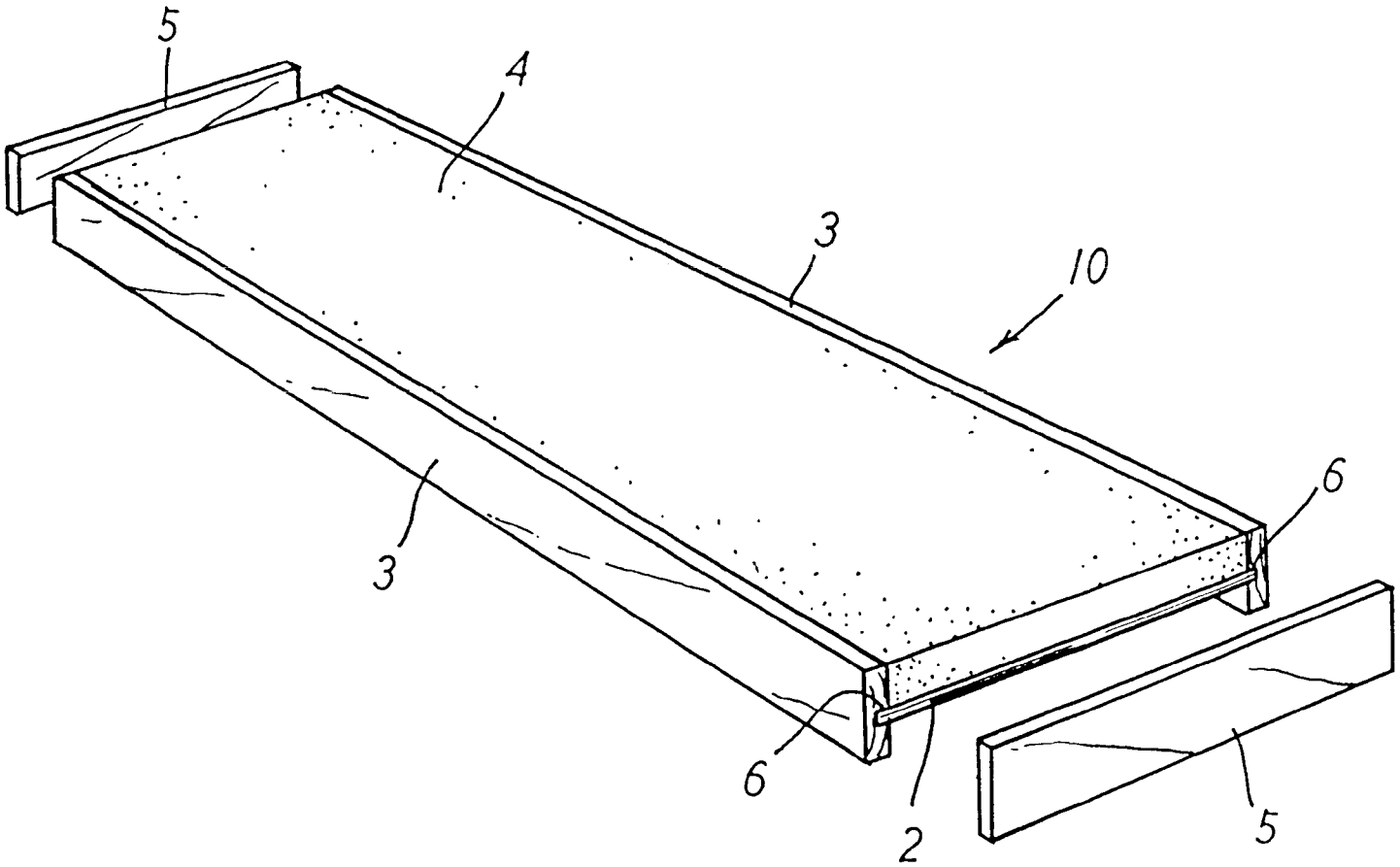
FIG. 2 is a schematic perspective view showing one example of a method for filling heat insulating material in accordance with the first embodiment.
Figure 3:
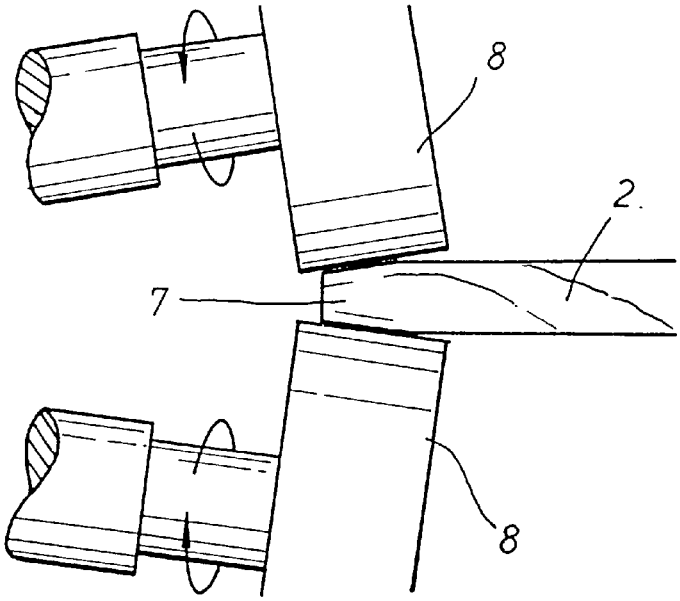
FIG. 3 is an illustration showing a method for manufacturing a housing panel in accordance with the first embodiment.

Also, in the case where the outer members 3 are provided only on both sides of the flat plate 2, as shown in FIG. 2, holder members 5 are brought into suitable contact with upper and lower end portions of the flat plate so that the heat insulating material 4 to be filled and poured would not flow out from the flat plate 2. The heat insulating material 4 is filled and poured and the heat insulating material 4 is cured. Thereafter, the holder members 5 in contact with the upper and lower end portions of the flat plate 2 are to be removed.

Also, in the case where the outer members 3 are provided around the entire outer circumference of the flat plate 2, a predetermined amount of heat insulating material 4 is simply filled and poured into the space formed by the flat plate 2 and the outer members 3.

A bonding method of the flat plate 2 with the outer members 3 will now be described with respect to FIGS. 3 to 7.

Figure 15:
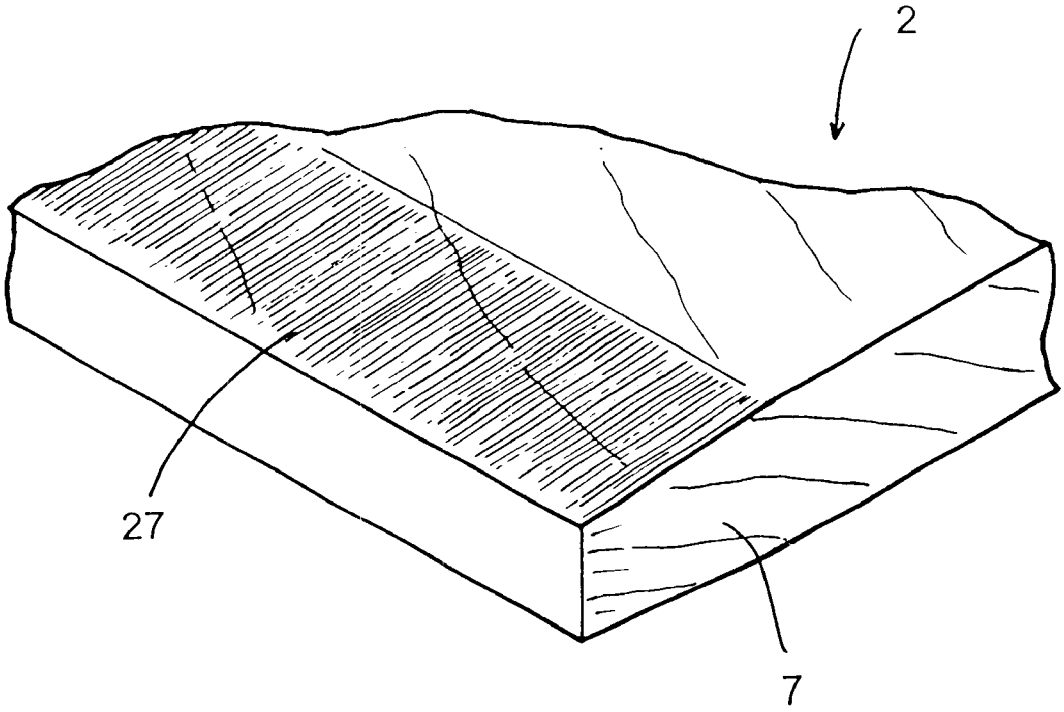
FIG. 15 is an enlarged view of the corrugations on the fitting portion.

The grooves 6 for fitting with the flat plate 2 are provided in the outer members 3. Fitting portions 7 of the flat plate 2 to be inserted into the grooves 6 are pressurized and depressed suitably by rollers 8 (see FIG. 3). The shape of the fitting portions 7 is compressed and at the same time, suitable corrugations 27 (see FIG. 15) are provided on the surface of the fitting portions 7 so that the final shape of the fitting portions 7 after the compression is formed is a tapered shape at its end. Accordingly, first of all, since the fitting portions 7 are tapered at their ends, the fitting portions 7 of the flat plate 2 may readily be inserted into the grooves 6.

Figure 4:
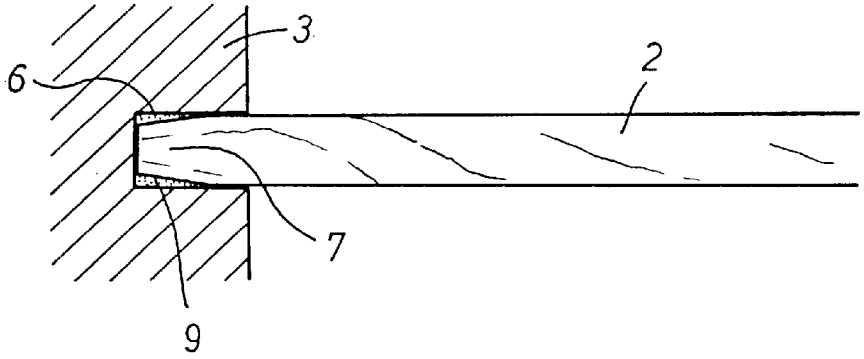
FIG. 4 is another illustration showing the method for manufacturing a housing panel in accordance with the first embodiment.
Figure 5:
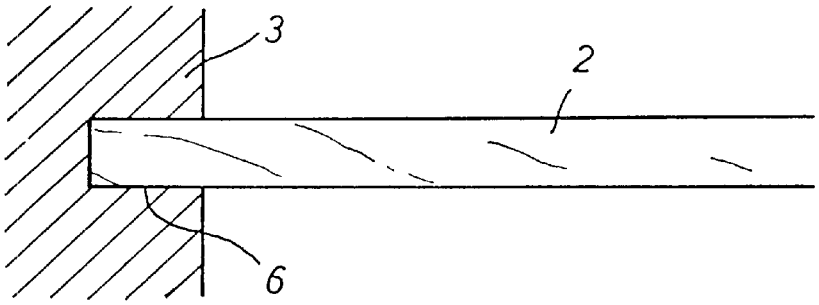
FIG. 5 is still another illustration showing the method for manufacturing a housing panel in accordance with the first embodiment.

Also, when the fitting portions 7 thus compressed are fitted in the grooves 6 of the outer members 3 through adhesives 9 (see FIG. 4), the compressed fitting portions 7 of the flat plate 2 inserted into the grooves 6 of the outer members 3 are adhered and expanded with the adhesives 9 so as to return to their original shape before the compression (see FIG. 5). Accordingly, the fitting portions 7 of the flat plate 2 are firmly and very intimately fitted and fixed within the grooves 6 of the outer members 3 through the adhesives 9. As a result, the flat plate 2 and the outer members 3 may be brought into very strong contact with each other in mechanical strength.

Figure 6:
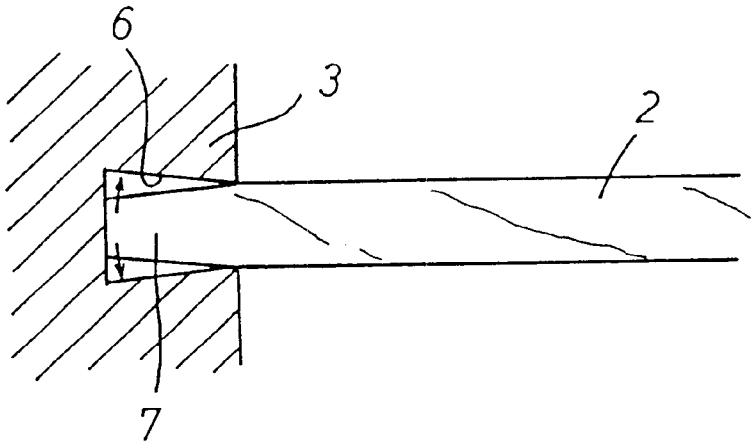
FIG. 6 is still another illustration showing the method for manufacturing a housing panel in accordance with the first embodiment.

The grooves 6 provided in the outer members 3 shown in FIGS. 4 and 5 have rectangular shape as viewed in side elevation. However, if a bottom portion of the grooves 6 is widened as shown in FIG. 6, when the compressed fitting portions 7 of the flat plate 2 are expanded due to the adhesion with the adhesives 9, the outer shape of the fitting portions 7 expands to be wider than the shape before compression, and the expanded fitting portions 7 are fitted intimately with the widened bottom portions of the grooves 6. As a result, it ensures the very strong structure in bonding strength between the flat plate 2 and the outer member.

Figure 7:
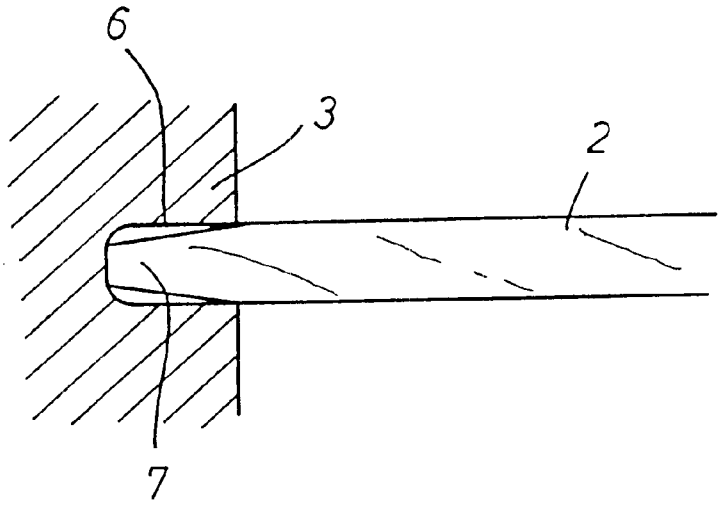
FIG. 7 is still another illustration showing the method for manufacturing a housing panel in accordance with the first embodiment.

Also, if the grooves 6 takes a shape with a round portion on the bottom side as shown in FIG. 7, it is possible to provide the structure where the outer members 3 fitted with the flat plate 2 is hardly damaged or cracked.

As described above, in accordance with the first embodiment of the invention, since the outer members 3 provided with the grooves 6 for fitting with the flat plate 2 are arranged at least on both sides of the flat plate 2 and the heat insulating material 4 is provided in the space formed by the flat plate 2 and the outer members 3, it is possible to readily provide the heat insulating material 4 with high precision so as not to expand beyond the outer members 3. Moreover, since the heat insulating material 4 is in contact with the top surface of the flat plate 2 and brought into contact with the outer members 3 provided at least on both sides of the flat plate 2, it is possible to enhance the bonding strength of the heat insulating material 4. It is therefore possible to bond the flat plate 2, the outer members 3 and the heat insulating material 4 with each other with high bondability to thereby exhibit satisfactory heat insulating effect. It is therefore possible to provide a housing panel that is high in quality and low in manufacture cost.

Also, since the heat insulating material 4 is poured and filled in the space formed by the flat plate 2 and the outer members 3, it is possible to positively pour and fill the heat insulating material 4 over the space formed by the flat plate 2 and the outer members 3 without any gap. Moreover, since the heat insulating material 4 is poured and filled so that the heat insulating material 4 is bonded to the flat plate 2 and the outer members 3 with high bondability, it is unnecessary to use the adhesives for bonding the heat insulating material 4 to the flat plate 2 as in the conventional case. It is therefore possible to readily provide the heat insulating material 4 to the housing panel 10 and to provide a method of manufacturing the housing panel which is high in quality and low in manufacture cost with a satisfactory heat insulation effect.

In the second embodiment, a housing panel 10 is fit in a space 17 defined by frame members 1 such as columns, bases, lintels, tie beams, struts, rafters or the like for closing the space. The panel 10 has at least one pair of outer members 3 that are brought into contact with the frame members 1 in conformity with the space portion 17. A flat member 2 is provided at a position retracted by a predetermined distance from both top and bottom edges of the outer members 3 within the inner surface of the outer members 3. Projecting pieces are provided to be integral with the flat plate 2 on the outer surface of the outer members 3.

These projecting pieces are formed to be fit into the grooves formed in, for example, the frame members 1 with which the outer members 3 are to be brought into contact.

Also, FIG. 8 shows the projecting pieces formed to project by the predetermined amount from the flat plate 2 at the end portions in the longitudinal direction of the outer members 3 but the projecting pieces may be formed by suitably providing projecting pieces that are discrete members from the flat plate 2.

In the third embodiment, a housing panel 10 is fit in a space 17 defined by frame members 1 such as columns, bases, lintels, tie beams, struts, rafters or the like for closing the space. Reinforcement members 3' are laminated on the outer surface of the outer members 3. The flat plate 2 is fitted and inserted into the grooves 6 of the outer members 3.

In the case where the size of the housing panel 10 is large, in some cases, it is impossible to form the long housing panel 10 with a single outer member 3. However, according to the third embodiment, to particularly cope with such a case, a plurality of outer members 3 are formed integrally with each other as the outer members 3 and the reinforcement members 3' are laminated on the outer surface of the plurality of integrated outer members 3.

When the reinforcement members 3' are to be laminated on the outer surface of the outer members 3, the reinforcement members 3' are laminated so that the positions between the integrated portions 13 of the outer member 3 and the integrated portion 13 of the reinforcement members 3' are displaced from each other whereby the mechanical strength of the outer members 3 may considerably be increased.

Furthermore, as shown in FIG. 9, the patterns or grains of wood 14 of the outer members 3 and the reinforcement members 3' are arranged in the laminated surface direction, and the patterns or grains of wood 14 of the outer members 3 and the reinforcement members 3' are different from each other, it is possible to suppress the deformation such as warpage of the outer members 3 and the reinforcement members 3' to provide the outer members 3 with high precision and high quality.

The fourth embodiment is a modification of the third embodiment. In this embodiment, a plurality (three in the embodiment) of the outer members 3 are laminated in a thickness direction of the outer members 3, the grooves 6 are provided on the side in which the flat plate 2 of the outer members 3 located in the central portion in the thickness direction is fitted, and the flat plate 2 is fitted and fixed in the grooves 6 of the outer members 3.

Thus, the housing panel 10 in which the outer members 3 are laminated in the thickness direction exhibits the same effect as that of the above-described reinforcement members 3' with the laminated outer members 3 and is very high in mechanical strength.

The fifth embodiment is an embodiment relating to the house using the housing panel.

The fifth embodiment is directed to the house using the housing panel for fitting in a space 17 defined by frame members 1 such as columns, bases, lintels, tie beams, struts, rafters or the like for closing the space 17. The above-described housing panel 10 is used at least in any portion of a wall, a floor, a ceiling, a ridge and a roof.

In the fifth embodiment, in the case where the housing panel 10 is mounted and fixed in the space 17 surrounded by the frame members 1, when the heat insulating material 4 is disposed to face the outside of the house, it is possible to prevent the generation of dew inside the house, and it is possible to effectively utilize the space formed by the flat plate 2 and the outside members 3 inside the house of the housing panel 10 as a space for arranging wirings and pipings.

Incidentally, when the housing panel 10 is to be mounted and fixed between the frame members 1, it is preferable that one where the flat plate 2 is projected by the predetermined amount from the upper and lower end portions in the longitudinal direction of the outer members 3 as in the housing panel 10 in accordance with the second embodiment or one where at least part of the flat plate 2 is projected from the outer members 3 fitted with the flat plate 2 is used, grooves in which the projections of the housing panel 10 may be fitted and fixed are formed in the frame members 1, and the projections of the housing panel 10 is fitted and fixed in the grooves formed in the frame members 1.

Figure 12:
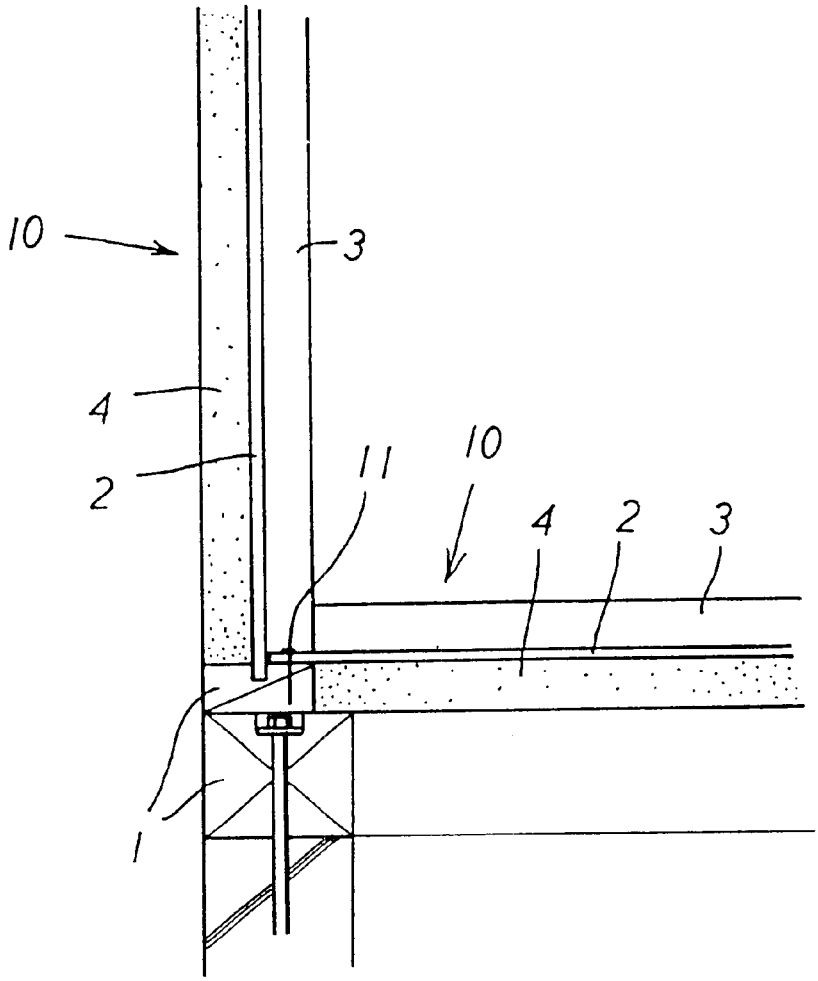
FIG. 12 is another illustration of the fifth embodiment.

FIG. 12 is an enlarged view showing the detail of the mounting portion of the housing panel 10 at the floor and the wall to the base as the frame members 1. In the housing panel 10 used for the wall, the flat plate 2 of the housing panel 10 projecting by the predetermined amount is fitted and fixed in the groove formed in the frame member 1, in the housing panel 10 used for the floor, the flat plate 2 of the housing panel 10 projecting by the predetermined amount is brought into contact with the frame member 1, the flat plate 2 and the frame member 1 are coupled and fixed with each other by joint members 11 such as nails from the upper side of the flat plate 2 projecting by the predetermined amount. Also, in this case, any heat insulating material 4 of the housing panel 10 is disposed to the outside of the house.

Figure 13:
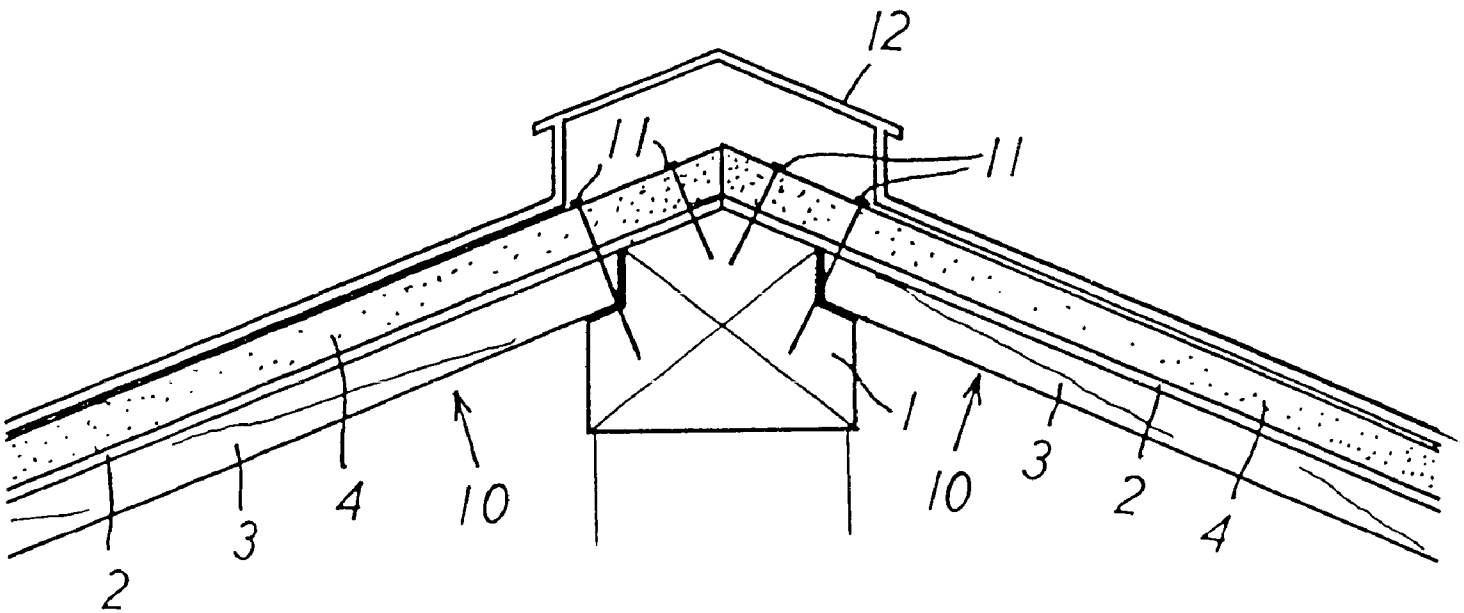
FIG. 13 is another illustration of the fifth embodiment.

FIG. 13 shows a case where the housing panel 10 is used for the roof. The flat plates 2 and the outer members 3 of the housing panels 10 are brought into contact with each other, and the flat plates 2 or the outer members 3 of the housing panels 10 and the ridge as the frame member 1 are coupled with each other by using joint members 11 such as nails on both of right and left sides of the ridge as the frame member 1 of the roof.

In this case, of the parts of the outer members 3 which contact with the ridge, the parts located below the flat plates 2 are cut suitably in conformity with the shape of the ridge.

Also, the heat insulating material 4 of the housing panels 10 are disposed on the outside of the house, and a roof member 12 is suitably provided on the outer surface of the housing panels 10.

Figure 14:
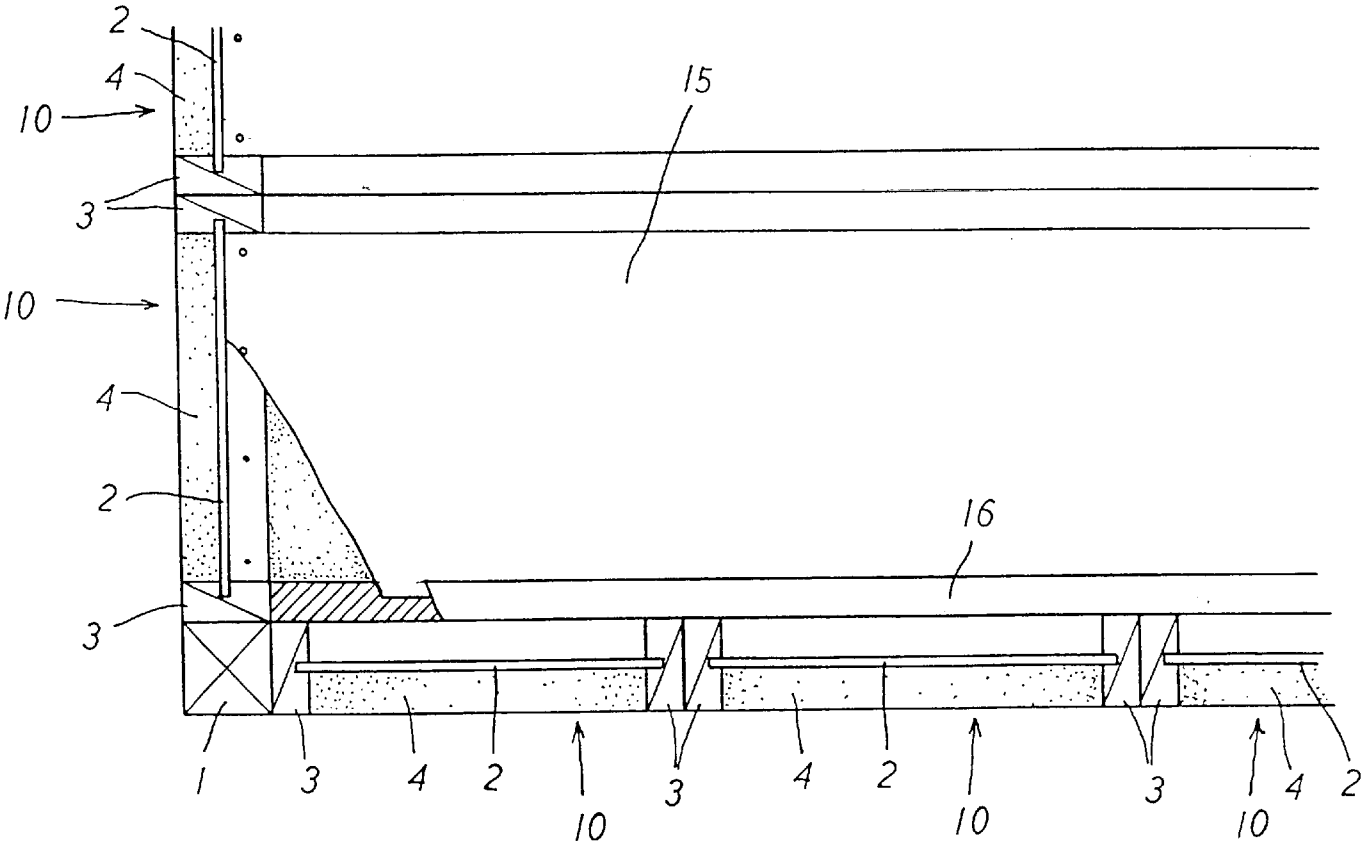
FIG. 14 is still another illustration of the fifth embodiment.

Also, FIG. 14 shows a case where the housing panel 10 is used between the columns as the frame members 1. A suitable number of housing panels 10 are used integrally between the columns. A floor member 15 is provided on the floor suitably, and an inner wall member 16 is provided on the inner wall suitably.

Also, in the conventional house, in order to increase the strength of the house, a horizontal angle brace is used suitably. However, the housing panels 10 according to the first to fourth embodiments of the invention are fitted and fixed in the spaces 17 surrounded by the frame members 1, and the outer members 3 of the housing panels 3 and the frame members 1 are coupled and fixed with each other by using the joint members such as nails suitably, whereby it is possible to very firmly fix the housing panels 10 to the frame members 1 and it is possible to provide a very durable house as a whole against the horizontal stress or the vertical stress without using the horizontal angle brace.

As described above, according to the fifth embodiment of the invention, when the housing panels 10 according to the first to fourth embodiments of the invention are used for the walls, the floors, the ceilings, the ridges and the roofs, when the house is to be built, the housing panels 10 according to this embodiment are mounted and fixed in the spaces surrounded by the frame members 1, whereby it is possible to build the house with ease to thereby make it possible to considerably shorten the building days for the house and to considerably reduce the building cost. In addition, the heat insulating effect of the housing panels 10 is great so that the heat insulating effect of the house as a whole is also great.

What is claimed is:

1. A housing panel for fitting with and closing a space surrounded by frame members of a house, comprising:

outer members provided with grooves; and a flat plate arranged between said outer members, so that at least two sides of said flat plate fit within said grooves, wherein heat insulating material is provided in a space portion defined by said flat plate and said outer members, wherein said flat plate projects from at least one longitudinal end portion of said outer members or projects from an outer surface of said outer members fitted with said flat plate.

2. The housing panel according to claim 1, wherein a reinforcement member is laminated on an outer surface of the outer members.

3. The housing panel according to claim 1, wherein a plurality of reinforcement members are laminated on the outer surface of the outer members.

4. The housing panel according to claim 2, wherein a grain pattern of the outer members and the reinforcement member are generally arranged in a direction of lamination, and the grain patterns of the outer members and the reinforcement members oppose each other.

5. The housing panel according to claim 3, wherein grain patterns of the outer members and the reinforcement members are generally arranged in a direction of lamination, and the grain patterns of the outer members and the reinforcement members oppose each other.

6. A housing panel for fitting with and closing a space surrounded by frame members of a house, comprising:

outer members provided with grooves; and a flat plate arranged between said outer members so at least two sides of said flat plate fit within said grooves, wherein said flat plate projects from at least one longitudinal end portion of the outer members by a predetermined amount.

7. The housing panel according to claim 6, wherein the flat plate projects from an outer surface of the outer members fitted with the flat plate.

8. The housing panel according to claim 6, wherein a reinforcement member is laminated on an outer surface of the outer members.

9. The housing panel according to claim 7, wherein a plurality of reinforcement members are laminated on the outer surface of the outer members.

10. The housing panel according to claim 8, wherein grain patterns of the outer members and the reinforcement member are generally arranged in a direction of lamination, and the grain patterns of the outer members and the reinforcement member oppose each other.

11. The housing panel according to claim 9, wherein grain patterns of the outer members and the reinforcement members are generally arranged in a direction of lamination, and the grain patterns of the outer members and the reinforcement members oppose each other.

12. A housing panel in combination with a house for fitting with and closing a space surrounded by frame members of the house, comprising:

at least one pair of confronting outer members having a shape in conformity with the space and in contact with the frame members;

a flat plate recessed a predetermined distance from both top and bottom end edges of the outer members and within an inner surface of the outer members;

a projecting piece integrally provided with the flat plate on the outer surface of the outer members, wherein the projecting piece is formed so as to fit in grooves formed in the frame members to which the outer members contact.

13. The housing panel according to claims 12, wherein a reinforcement member is laminated on an outer surface of the outer members.

14. The housing panel according to claim 13, wherein grain patterns of the outer members and the reinforcement member are generally arranged in a direction of lamination, and the grain patterns of the outer members and the reinforcement member oppose each other.

15. A method for manufacturing a housing panel for fitting with and closing a space surrounded by frame members of a house, comprising the steps of:

providing outer members having grooves;

fitting said outer members with a flat plate, wherein at least two edges of the flat plate fit in said grooves; and pouring and filling heat insulating material in a space formed by the flat plate and the outer members.

16. A method for manufacturing a housing panel for fitting with and closing a space surrounded by frame members of a house, comprising the steps of:

providing outer members having grooves;

fitting said outer members with a flat plate, wherein at least two edges of the flat plate fit in said grooves;

providing holder members in contact with upper and lower end portions of the flat plate;

pouring heat insulating material into a space partially defined by the holder members, wherein the holder members prevent the heat insulating material from overflowing from the flat plate to an area outside of the flat plate; and after the heat insulating material has been cured, removing the holder members from contact with the upper and lower end portions of the flat plate.

17. A house using a housing panel for fitting with and closing a space surrounded by frame members of the house, the housing panel comprising:

outer members provided with grooves;

a flat plate arranged between said outer members so at least two edges of said flat plate fit within said grooves; and heat insulating material provided in a space portion defined by the flat plate and the outer members, wherein said flat plate projects from at least one longitudinal end of said outer members by a predetermined amount for use in at least one of a wall, a floor, a ceiling, a ridge and a roof.

18. A house using a housing panel for fitting with and closing a space surrounded by frame members of the house, the housing panel comprising:

at least one pair of confronting outer members having a shape in conformity with the space and in contact with the frame members;

a flat plate recessed a predetermined distance from both top and bottom end edges of the outer members and within an inner surface of the outer members; and a projecting piece integrally provided with the flat plate on the outer surface of the outer members, wherein the projecting piece is formed so as to fit in grooves formed in the frame members to which the outer members contact for use in at least one of a wall, a floor, a ceiling, a ridge and a roof.

19. A method for manufacturing a house with a housing panel for fitting with and closing a space surrounded by frame members of the house, comprising the steps of:

providing outer members having grooves fitting said outer members with a flat plate, wherein at least two edges of the flat plate fit in said grooves; and pouring heat insulating material in a space formed by the flat plate and the outer members for use in at least one of a wall, a floor, a ceiling, a ridge and a roof.

20. A method for manufacturing a house with a housing panel for fitting with and closing a space surrounded by frame members of the house, comprising the steps of:

providing outer members having grooves;

fitting said outer members with a flat plate, wherein at least two edges of the flat plate fit in said grooves; and providing holder members in contact with upper and lower end portions of the flat plate;

pouring heat insulating material into a space partially defined by the holding members so as to prevent the heat insulating material from overflowing from the flat plate to an area outside of the flat plate; and after the heat insulating material has been cured, removing the holder members from contact with the upper and lower end portions of the flat plate for use in at least one of a wall, a floor, a ceiling, a ridge and a roof.

* * * * *

UNITED STATES PATENT AND TRADEMARK OFFICE

CERTIFICATE OF CORRECTION

PATENT NO. : 6,438,916 B1
DATED : August 27, 2002
INVENTOR(S) : Tadashi Ueki

It is certified that error appears in the above-identified patent and that said Letters Patent is hereby corrected as shown below:

Column 8,
Line 46, delete “formed is a tapered” and insert -- formed into a tapered --;

Column 9,
Line 5, delete “member.” and insert -- members 3. --

Signed and Sealed this

Thirty-first Day of December, 2002

JAMES E. ROGAN
*Director of the United States Patent and Trademark Office*